US005212855A

United States Patent [19]

McGanty

[11] Patent Number: 5,212,855

[45] Date of Patent: May 25, 1993

[54] MULTIPLE BUTTON CLOSURE-FASTENER

[76] Inventor: Leo F. McGanty, 186 Long Hill Rd., Bolton, Mass. 01740

[21] Appl. No.: 740,134

[22] Filed: Aug. 5, 1991

[51] Int. Cl.[5] ..... A44B 17/00

[52] U.S. Cl. ..... 24/580; 24/452

[58] Field of Search ..... 24/442–444, 24/662, 697.1, 30.5 R, 580, 575, 576, 578, 452, 662, 16 PB; 604/391; 383/63, 95

[56] References Cited

U.S. PATENT DOCUMENTS

| | | | |
|---|---|---|---|
| 3,325,084 | 6/1967 | Ausnit | 383/63 X |
| 3,899,805 | 8/1975 | McMillan | 24/575 |
| 3,918,131 | 11/1975 | Ausnit | 24/576 |
| 4,581,792 | 4/1986 | Spier | 24/575 |
| 4,691,373 | 9/1987 | Ausnit | 24/576 X |
| 4,870,721 | 10/1989 | Cohen | 24/16 PB |
| 4,947,527 | 8/1990 | Hennig | 24/662 X |
| 5,088,164 | 2/1992 | Wilson et al. | 24/575 X |

FOREIGN PATENT DOCUMENTS

| | | | |
|---|---|---|---|
| 1132628 | 3/1957 | France | 24/576 |

*Primary Examiner*—James R. Brittain

*Attorney, Agent, or Firm*—Leo F. McGanty

[57] ABSTRACT

The multiple button closure-fastener is a separable strip closure-fastener made from a suitable plastic material comprising a multiple conical male button strip and a multiple conical female button strip. All male and female buttons are coaxial at point of engagement and when pressed together the male buttons snap into the female buttons engaging a like curve causing a pulling together of the male and female surfaces, thus making a mechanical closure with a liquid and hermetic seal. This closure-fastener can also be used in numerous instances where there is no need for a liquid or hermetic seal.

7 Claims, 3 Drawing Sheets

MULTIPLE BUTTON CLOSURE-FASTENER

BACKGROUND OF THE INVENTION

This invention relates to a separable plastic closure-fastener that will give a liquid and hermetic seal. It can also be used as a fastener where a seal is not necessary.

It has been a source of discouragement heretofore to all of us when a cereal box, milk carton, bread bag, cookie box or any food container could not be resealed quickly and easily after the initial opening. How much food has been wasted simply because it couldn't be properly resealed. The Zip-loc closure, to a certain degree, does seal, but the annoyance most of us have experienced trying to seat the Zip-loc, and its relatively expensive nature, make it not entirely desirable. There is truly no effective seal therein used on cookie boxes, cereal boxes and the like. Bread bags do have the awkward wire fastener or plastic clip that almost make it impossible to use effectively by a younger child or elderly person. Fasteners on items such as boots, shoes, belts, outerwear, and the like are often awkward and tedious. We are all familiar with Velcro and its many uses, mainly on wearing apparel and such. Nevertheless, it does have limitations regarding its pull strength. Velcro is also relatively expensive. The simple act of beginning a zipper can be a monumental challenge to a child and at times, not the least of a challenge to the elderly.

There is certainly dire need for a simple inexpensive separable closure-fastener, preferable made out of a common material such as plastic that could be manufactured quickly and easily at a cost of mils or pennies per unit.

SUMMARY OF THE INVENTION

The present invention provides a separable plastic closure-fastener comprised of a male button strip and a female button strip. When these two strips are in the interlocked position, the fastener provides a liquid and hermetic seal. It could be used in a myriad number of applications which to name a few would be: food freezer bags, sandwich bags, bread bags, cake boxes, cookie bags, plastic bags for hardware, milk cartons, cereal boxes, etc.

This closure-fastener, without the need of the liquid and hermetic seal, could also be used as tabs or patches on shoes, boots, belts, jackets. It could be used just about any place Velcro is used and would offer more pull strength when needed. It would also be less expensive.

It also could be used in utility doors and the like such as kitchen or bathroom cabinets. It could be used in innumerable instances where two surfaces need to be joined by a fastener. In these instances, this plastic fastener would be in the form of a patch or tab and would be mounted with an adhesive back or hardware.

BRIEF DESCRIPTION OF THE DRAWINGS

Advantages of this invention will become apparent to persons skilled in the art upon reading the illustrated embodiments in the following drawings combined with the written embodiments of the invention.

DESCRIPTION OF PREFERRED EMBODIMENTS

The separable plastic multiple button closure-fastener is shown in its entirety in FIGS. 1 to 12 of the drawings, comprising a plan view of a portion of the male button strip 1 therein and a plan view of a portion of the female button strip 2 therein.

Figure 1:
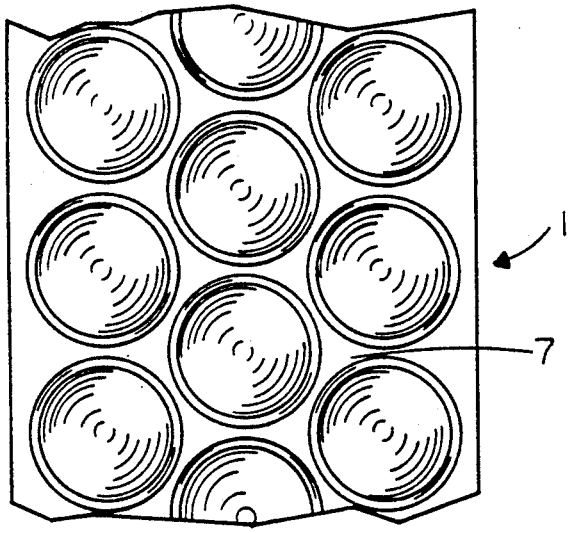
FIG. 1 is a plan view of the male button strip.
Figure 3:
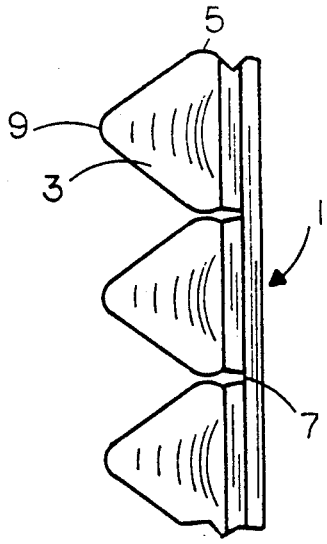
FIG. 3 is a side view of the male button strip.
Figure 2:
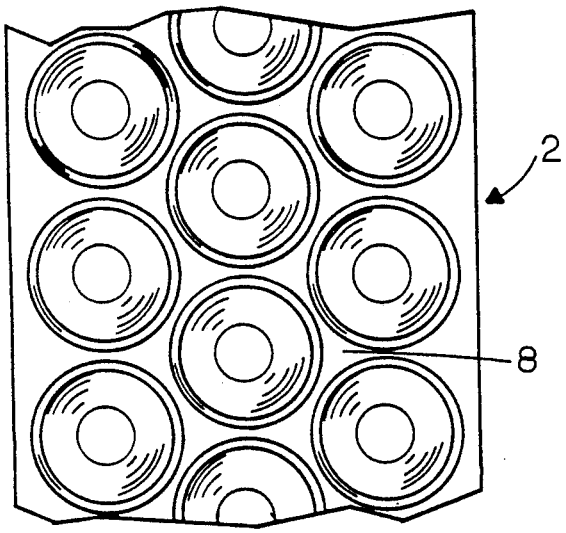
FIG. 2 is a plan view of the female button strip.
Figure 4:
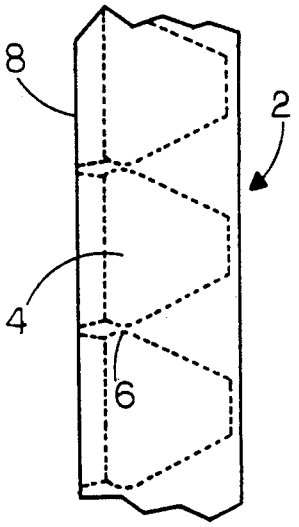
FIG. 4 is a side view of the female button strip.
Figure 5:
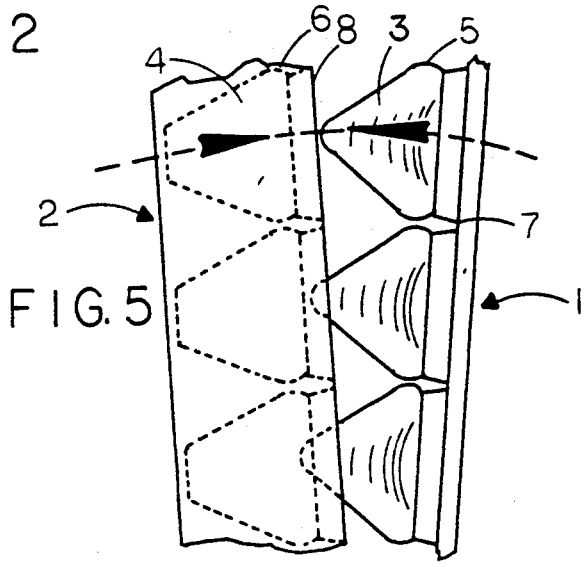
FIG. 5 is a side view of both the male button strip and female button strip approaching a closed position.

FIG. 5 shows the male button strip 1 and female button strip 2 moving rotationally to a coaxial fully interlocked position. The male buttons 3 and female buttons 4, on being pressed together and cooperating in an interlocking position therein, produce the seal. This seal is actually accomplished thus: when the strips are in the closed position, the annular curve 5 on the male buttons pulls on the annular curve 6 on the female buttons. This pulling is the result of the distance between the centerline of the annular curve 5 and planar surface 7 therein being less than the distance between the centerline of the annular curve 6 and planar surface 8 therein. Because the male and female buttons are circular, as shown in FIGS. 1 and 2, the pulling created by the offset annular curves is evenly distributed to all areas of planar surface 7 and planar surface 8 thereon, producing an even seal across the entire strip when the closure is in an interlocked position. This seal would be made more positive by using the minimal amount of opposing planar surfaces 7 and 8 for a more effective seal. The only surfaces that will be touching in the closed or interlocked position would be the annular curves 5 and 6 thereof and planar surfaces 7 and 8 thereof. There would be clearance on all other surfaces at the closed interlocked position, thus reducing the sealing area contact, thus reducing the chance of seal failure, this being analagous to an 'O' ring making a better seal than a flat ring. The male buttons have the curve 9 to help facilitate any necessary side sliding movement to better steer themselves into a coaxial, fully cooperating position therein with the female buttons.

Figure 6:
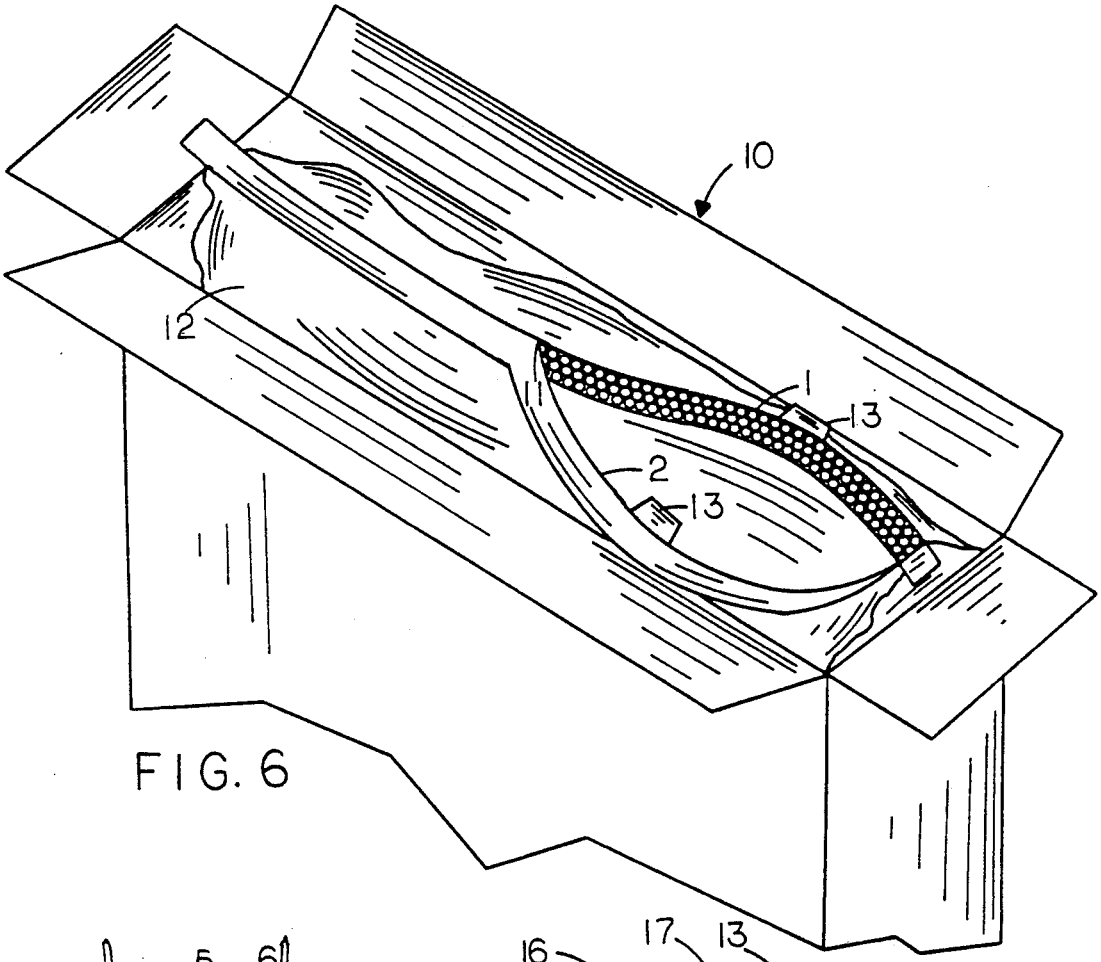
FIG. 6 is a perspective drawing of a cereal box showing the button fastener.
Figure 7:
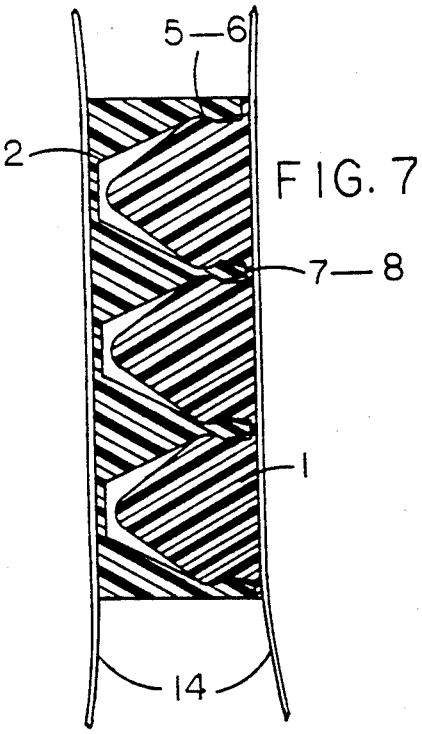
FIG. 7 is a sectional view of the closed button fastener viewed in the direction of the 7—7 arrows.
Figure 8:
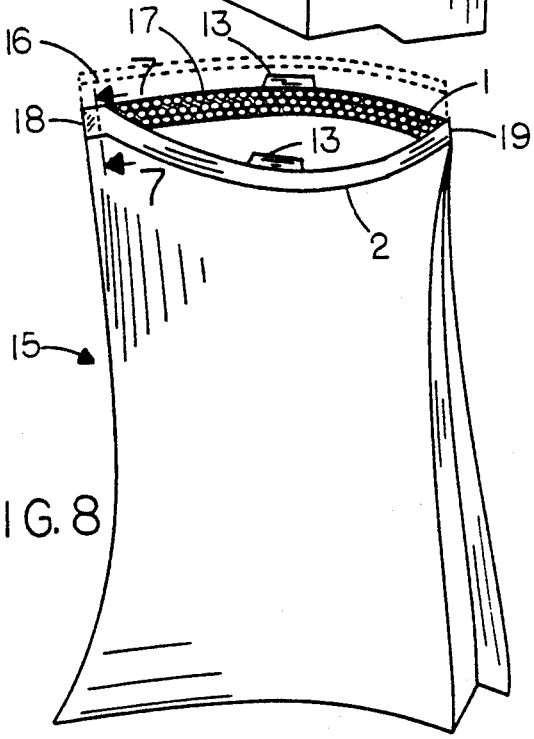
FIG. 8 is a perspective view of a food bag.
Figure 9:
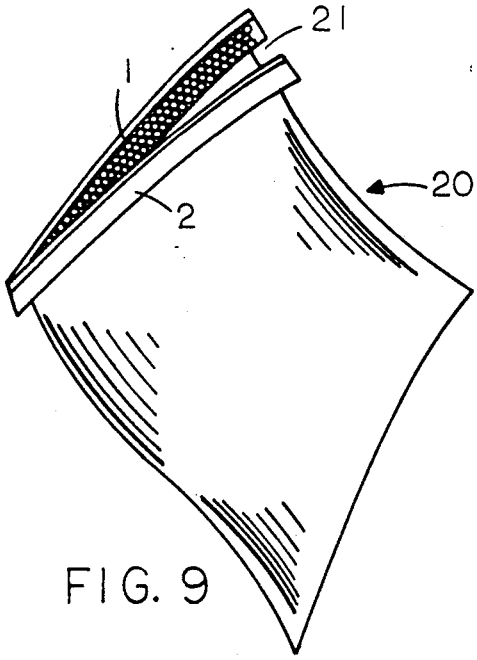
FIG. 9 is a perspective view of a sandwich bag.
Figure 10:
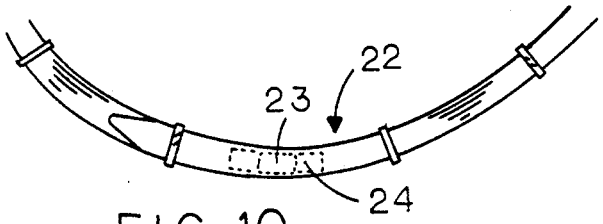
FIG. 10 is a perspective view of a pants belt using the button fastener.
Figure 11:
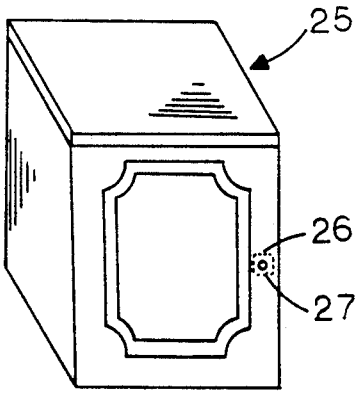
FIG. 11 is a perspective view of a kitchen cabinet using the button closure-fastener.
Figure 12:
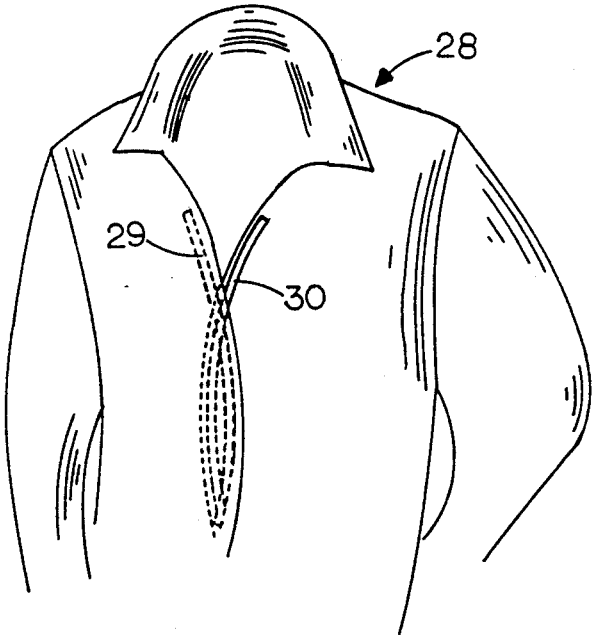
FIG. 12 is a perspective view of a jacket using the button closure-fastener.

The perspective drawing as shown in FIG. 6 is a cereal box 10 with button strips 1 and 2 fully opened to the maximum therein to point 11. The button strips would be thermally bonded to the plastic bag 12. The integral tab 13 would facilitate pulling open the closure. The sectional view FIG. 7 taken from FIG. 8 thereof, shows the male button strip 1 and the female button strip 2 in a fully interlocked and cooperating position. The only contact the male and female buttons make is at the upper parts of the curves 6 and 5 and the planar surfaces 7 and 8. The plastic filament 14 is bonded to the button strips therewith. The food bag 15 shows the button strips 1 and 2 in the opened position. The tabs 13 are used to facilitate opening. The dotted line above the closure-fastener is part of the bag 15 that could be thermally sealed along the dotted line at 16 to give a double seal, and indented along the line at 17 just above the button strip to allow peeling away. To insure a complete liquid and hermetic seal, a thermal bonding of the plastic bag 15 to the button strips 1 and 2 therein could be accomplished at the corners 18 and 19 with the proper bonding irons and fixtures thereof. The sandwich bag 20 shows the button strips 1 and 2 opening at point 21 which shows the side of the bag parted about an inch to facilitate opening the strip. Quite obviously, tabs could be put on top of the strip as shown in FIG. 8.

The multiple button closure-fastener abviously could be used as a simple mechanical fastener thereof without a liquid or hermetic seal. It could be used in a myriad of situations not only using plastic bags but also as a fastener for milk cartons, envelopes, boxes, and many types of containers. It could also be used very effectively on clothing apparel. The shape of the button strips could be in strip form, a small circular or square piece, or any other convenient configuration thereof. The back of this patch of button strip could be suited to accomodate an adhesive which would bond to any number of surfaces thereon. In cases where the patch of button strip would be joined to a member by hardware or stitching thereon, it would be a simple matter of extending the planar surface of the button strip beyond the button pattern.

The pants belt 22 uses a rectangular male button patch 23 on the inside of the outside overlapping part of the belt thereof and a longer rectangular female button patch 24 on the underlying part of the belt. The kitchen cabinet 25 has a male button patch 26 on the door member therein and a slightly floating female button patch 27 on the cabinet member thereon. It is obvious that the button closure-fastener would have probably more extensive use as a mechanical fastener, without using the hermetic or liquid seal.

On jacket 28 the male button strip 29 therein would engage the female button strip 30. This use of the button closure-fastener could be used on just about any clothing apparel.

Although a cylindrical configuration is shown on the individual buttons, a rectangular, square, or other geometrical configuration could be used to achieve the same seal on the cooperating planar surfaces. However, these other configurations would be more difficult to manufacture. The button strips could be injection-molded or vacuum-formed from a yieldable plastic material therein having good memory traits which would give it the ability or nature to return to its original shape thereof following a temporary deformation. The plastic used could vary in thickness from less than 0.001 and up for vacuum-forming and ranging up to larger thicknesses for strength requirements involving an injection-molded process. The plastic used could have character traits that greatly range in hardness, flexibility, elasticity, and other traits designed for an intended use. The curves 7 and 8 on the male and female buttons could be increased or decreased to afford a tighter or looser engagement. The size of the button will affect the tightness of the closure and may be increased or decreased to whatever is needed. Three rows of buttons have been used throughout the drawings. Quite obviously, the number of rows of buttons could be any number needed to fulfill the necessary pull strength and tightness of seal. The multiple button closure-fastener could be vacuum-molded directly into a bread bag or the like with a properly formulated plastic. Extremely small buttons, even microscopic in nature, could be made in micromachined molds that would offer a closure-fastener for items needing a light touch engagement. On the other end of the spectrum, a much heavier button closure-fastener could be used for hermetically sealing machine parts such as automobile engines in transit. A heavy closure-fastener such as this could be closed with a leveraged tooling means. The heavy-duty plastic bag could then be used many times. When closing the button strip it is almost unnecessary to look at what you are doing therein because the male and female strips have a tendency to center themselves thereof with very little direction from the user.

The multiple button closure-fastener would be an extremely inexpensive product to manufacture. Large sheets with many thousands of buttons could be injection-molded in solid button form or vacuum-formed from sheets of filament plastic with hollow buttons. Both the male button sheet and the female button sheet could then be joined in the interlocked position. It would then be possible to slice off the width needed in large quantities.

It would be possible to make the male and female button sheets in a continuous roll. Then a parting or slicing machine could cut whatever width would be needed. This cut strip could then be made into a complete roll of closure-fastener material.

It has been documented heretofore in the written preferred embodiments and in the drawings of the invention showing the effective yet simplistic plastic fastener therein that it has superior sealing advantages, a broad application of uses, and a very economical manufacturing process. Nevertheless, it should be known that these stated embodiments thereof were for illustration purposes only and were not meant in any way to place limitation on the invention. The invention is, however, in accordance with the following claims.

That which is claimed is:

1. A separable flexible closure-fastener means comprising a series of adjacent round, conical-shaped male buttons, such buttons protruding from an integral planar surface forming a button strip, said button strip being formed on a deformable plastic sheet, such male buttons coaxially opposing a strip of female buttons, such strip of female buttons being cavities in an integral planar surface having the same shape as the male buttons being round and conical, said female button strip being formed on a deformable plastic sheet; the male buttons on being pushed into said female buttons past an annular ridge in the female buttons to the fully engaged and closed position accomplish a liquid and hermetic seal, said seal being caused by the annular curves on the male buttons engaging the annular curves on the female buttons, said male button annular curves located at the largest diameter of the male buttons, said female button annular curves located at the largest diameter of the female buttons, said liquid and hermetic seal being created by having said annular curves on the male buttons of less distance from the planar surface of said male button strip, said planar of said male button strip being closest to the largest diameter on the male buttons, said annular curves on the female buttons a greater distance from the planar surface of said female button strip, said planar surface of said female button strip being closest to the largest diameter of the female buttons, said both male button annular curves and female button annular curves pulling against each other will cause the planar surface closest to the largest diameter of the male buttons and the planar surface closest to the largest diameter of the female buttons to become tightly engaged to effect a complete liquid and hermetic seal across the engaged male button strip and female button strip.

2. A separable flexible closure-fastener as defined in claim 1 wherein: a curve on a bottom tip of the male button, such curve being located at the smallest diameter of the male button, said curve meeting the slanted straight sides of the male button at all points of a circle, said curve to facilitate any necessary movement to better steer the male buttons into a coaxial, fully cooperating position therein with the female buttons.

3. A separable flexible closure-fastener as defined in claim 1 wherein: a separate strip of male buttons and a separate strip of female buttons, said male button strip and female button strip bonded in a coaxial opposing position on another piece of plastic or other type material, a bonding surface on the male button strip being the entire planar surface that is the opposite surface from which the male buttons protrude and the bonding surface on the female button strip being the entire planar surface that is the opposite surface from which the female cavities begin.

4. A separable flexible closure-fastener as defined in claim 1 wherein: when the closure-fastener is in the fully closed position the only part of the male button strip and the female button strip in contact with each other thereof will be at the annular curves of the male buttons, said annular curves located at the largest diameter of the male buttons and the annular curves of the female buttons said annular curves located at the largest diameter of the female buttons, the only other surfaces being in minimal contact are the planar surface of said male button strip nearest the largest diameter of the male buttons and the planar surface of said female button strip nearest the largest diameter of the female buttons; the remaining surfaces having no contact are the surfaces next to the space between female button cavity and the male button, these non-contact areas will give a more positive seal, such seal being at the opposing minimal planar surfaces.

5. A separable flexible closure-fastener as defined in claim 1 wherein: each row of multiple rows of the male buttons are staggered one row to the other, thus causing a nesting effect, such nesting effect causing the male buttons to be in the closest geometrical configuration as possible, allowing the least amount of the planar surface of said male button strip nearest the male button to be exposed, such amount of planar surface being consistent with the best seal, and each row of multiple rows of the female buttons are staggered one row to the other, thus causing a nesting effect, such nesting effect causing the female buttons to be in the closest geometrical configuration as possible, allowing the least amount of the planar surface of the female button strip nearest the female button to be exposed.

6. A separable flexible closure-fastener as defined in claim 1 wherein: a tab to be an integral part of the male button strip, said tab positioned between ends of the said male button strip, and a second tab to be an integral part of the female button strip, said second tab positioned between ends of the said female button strip, for the purpose of facilitating the easy pulling open of the closure-fastener.

7. A separable flexible closure-fastener as defined in claim 1 wherein: the male button strip would have an adhesive, said adhesive bonded to a planar surface of said male button strip, said bonded planar surface furthest from the largest diameter of said male button, and the complementary female button strip would have an adhesive, said adhesive bonded to a planar surface of said female strip, said bonded planar surface of said female button strip furthest from the largest diameter of said female button.

* * * * *